US011067359B1

(12) United States Patent
Chiang

(10) Patent No.: US 11,067,359 B1
(45) Date of Patent: Jul. 20, 2021

(54) EXPANDABLE BATON

(71) Applicant: Kuei-Chih Chiang, Taichung (TW)

(72) Inventor: Kuei-Chih Chiang, Taichung (TW)

( * ) Notice: Subject to any disclaimer, the term of this patent is extended or adjusted under 35 U.S.C. 154(b) by 0 days.

(21) Appl. No.: 17/154,020

(22) Filed: Jan. 21, 2021

(51) Int. Cl.
*F41B 15/02* (2006.01)

(52) U.S. Cl.
CPC ..... *F41B 15/027* (2013.01)

(58) Field of Classification Search
CPC ..... F41B 15/027
USPC ..... 463/47
See application file for complete search history.

(56) References Cited

U.S. PATENT DOCUMENTS 4,037,839 A * 7/1977 Nelson ..... F41B 15/027 463/47.7
6,231,447 B1 * 5/2001 Pelkey ..... F41B 15/027 403/368
2013/0150167 A1 * 6/2013 Pelkey ..... F41B 15/027 463/47.7
2015/0038239 A1 * 2/2015 Parsons ..... F41B 15/027 463/47.7
2015/0038240 A1 * 2/2015 Parsons ..... F41B 15/027 463/47.7
2016/0169616 A1 * 6/2016 Cheng ..... F41B 15/00 463/47.7

FOREIGN PATENT DOCUMENTS

DE 202013105282 U1 * 12/2013 ..... F41B 15/027
EP 0961097 A2 * 12/1999 ..... F41B 15/027
JP 4301460 B1 * 7/2009 ..... F41B 15/027
WO WO-2020060899 A1 * 3/2020 ..... F41B 15/027

* cited by examiner

*Primary Examiner* — William M Pierce

(57) ABSTRACT

An expandable baton includes a first tube; a second tube disposed in the first tube; at least one lock mechanism disposed on a first end of the second tube, clamped to an inner surface of the first tube and including a locking pipe, two lock protuberances and two elastic members, the lock protuberances correspondent to each other and the elastic members disposed between the two lock protuberances; a release mechanism including a lock needle and a pushbutton, a pressing of the pushbutton moves the lock needle to insert into the lock mechanism, the lock protuberances depart from the first tube simultaneously and urge the elastic members to an unlocked position, without a pressing of the pushbutton, the restored elastic members enable the lock protuberances to a locked position; and a positioning member for limiting the release mechanism at a first end of the first tube.

6 Claims, 8 Drawing Sheets

EXPANDABLE BATON

BACKGROUND OF THE INVENTION

1. Field of the Invention

The invention relates to expandable baton and more particularly to an expandable baton with lock protuberances that move towards each other and away from each other without any lag of time.

2. Description of Related Art

Expandable batons are widely used by law enforcement personnel or as a personal protection means. A conventional expandable baton comprises a plurality of telescopic tubes shown in FIGS. 9 to 11. The baton can be expandable between an extended position and a retracted position. As shown, a smaller tube 70 is partially retracted into a larger tube 72. At the extended position, the smaller tube 70 extends out of an end of the larger tube 72 and a lock mechanism 74 deposed on the smaller tube 70 is clamped with an inner surface of the larger tube 72. As an end, the baton is expanded. Further, when pressing a lock needle 78 of a release mechanism, the smaller tube 70 is retracted into the larger tube 72. The lock mechanism 74 includes a first lock protuberance 761 and a second lock protuberance 762. An end of the first lock protuberance 761 further includes a first through hole 7611 and an end of the second lock protuberance 762 includes a second through hole 7621. When the first lock protuberance 761 and the second lock protuberance 762 are combined together, the first through hole 7611 and the second through hole 7621 overlap, with the first through hole 7611 in the front end and the second through hole 7621 in the rear end.

Shown in FIGS. 10 and 11, the first through hole 7611 and the second through hole 7621 are disposed on the front end and the rear end respectively. Thus, when pressing the lock needle 78, the lock needle 78 is first inserted into the first through hole 7611 of the first lock protuberance 761, and then inserted into the second through hole 7621 of the second lock protuberance 762, not inserted simultaneously into the first through hole 7611 and the second through hole 7621. The first lock protuberance 761 and the second lock protuberance 762 may depart from a correct position (shown in broken lines in FIGS. 10 and 11). As a result, the first lock protuberance 761 and the second lock protuberance 762 may not be perfectly clamped to the inner surface of the larger tube 72 and may be easily abraded. After a period of time, the first lock protuberance 761 and the second lock protuberance 762 may be deformed or damaged.

Thus, the need for improvement still exists.

SUMMARY OF THE INVENTION

It is therefore one object of the invention to provide an expandable baton comprising a first tube including a first annular groove on an inner surface; a second tube moveably disposed in the first tube; at least one lock mechanism disposed on a first end of the second tube, movably clamped to the first annular groove and including a locking pipe, two lock protuberances and two elastic members wherein the locking pipe includes two shifting slots positioned at two opposite walls and provided with a plurality of pillars paralleled to each other and disposed between the two shifting slots, enabling the two lock protuberances movably positioned in the two shifting slots, one end of each of the lock protuberances further including two hollow seats positioned symmetrically, each of the hollow seats provided with the correspondent elastic member, a concaved slot formed between the two hollow seats, each of the lock protuberances provided with an arch portion elongated towards an end opposite from the hollow seats and forming an arch slot on an inner surface, a distance between each of the arch portions and one end of the first tube is equal to a length of the lock protuberances and the one end of the first tube, an outer surface of the arch portion provided with a protrusion projecting towards an end opposite from the concaved slot, the protrusion and the concaved slot aligned axially, one of the protrusions of the lock protuberances is correspondent to the concaved slot of the other lock protuberance, the protrusions inserted into the concaved slots form a through hole; a release mechanism including an axially moveable lock needle having a pointed second end and a pushbutton at a first end, the pushbutton projecting out of the first tube; and a positioning member for limiting the release mechanism at a first end of the first tube. A pressing of the pushbutton moves the lock needle to insert into the lock mechanism, the lock protuberances departed from the first annular groove simultaneously and urged the elastic members to an unlocked position. Without a pressing of the pushbutton, the restored elastic members enable the lock protuberances to return to the first annular groove simultaneously to a locked position.

The invention has the following advantages and benefits in comparison with the conventional art: The two lock protuberances move simultaneously. Due to the symmetrical structure of the lock protuberances and the axial alignment of the protrusions and the concaved slots, when the lock needle is inserted into the lock protuberances, the lock needle presses the arch portions of the two lock protuberances simultaneously. As a result, the two lock protuberances move towards each other without any time lag.

Greatly decreased molding costs. This is because the two lock protuberances are symmetrical, only one mold is needed. Thus, the cost for molding the lock protuberances is decreased.

The two lock protuberances are locked faster and steadier. Each lock protuberance is supported by the two elastic members, and the elastic members are symmetrically and correspondently disposed in the lock protuberances. Thus, when the lock protuberances of the lock mechanism is about to move to the first annular groove, the elastic member provides a quicker and steadier restoring force to push the lock protuberances back to the first annular groove. The second tube is clamped to the first tube faster and steadier.

The above and other objects, features and advantages of the invention will become apparent from the following detailed description taken with the accompanying drawings.

DETAILED DESCRIPTION OF THE INVENTION

Figure 1:
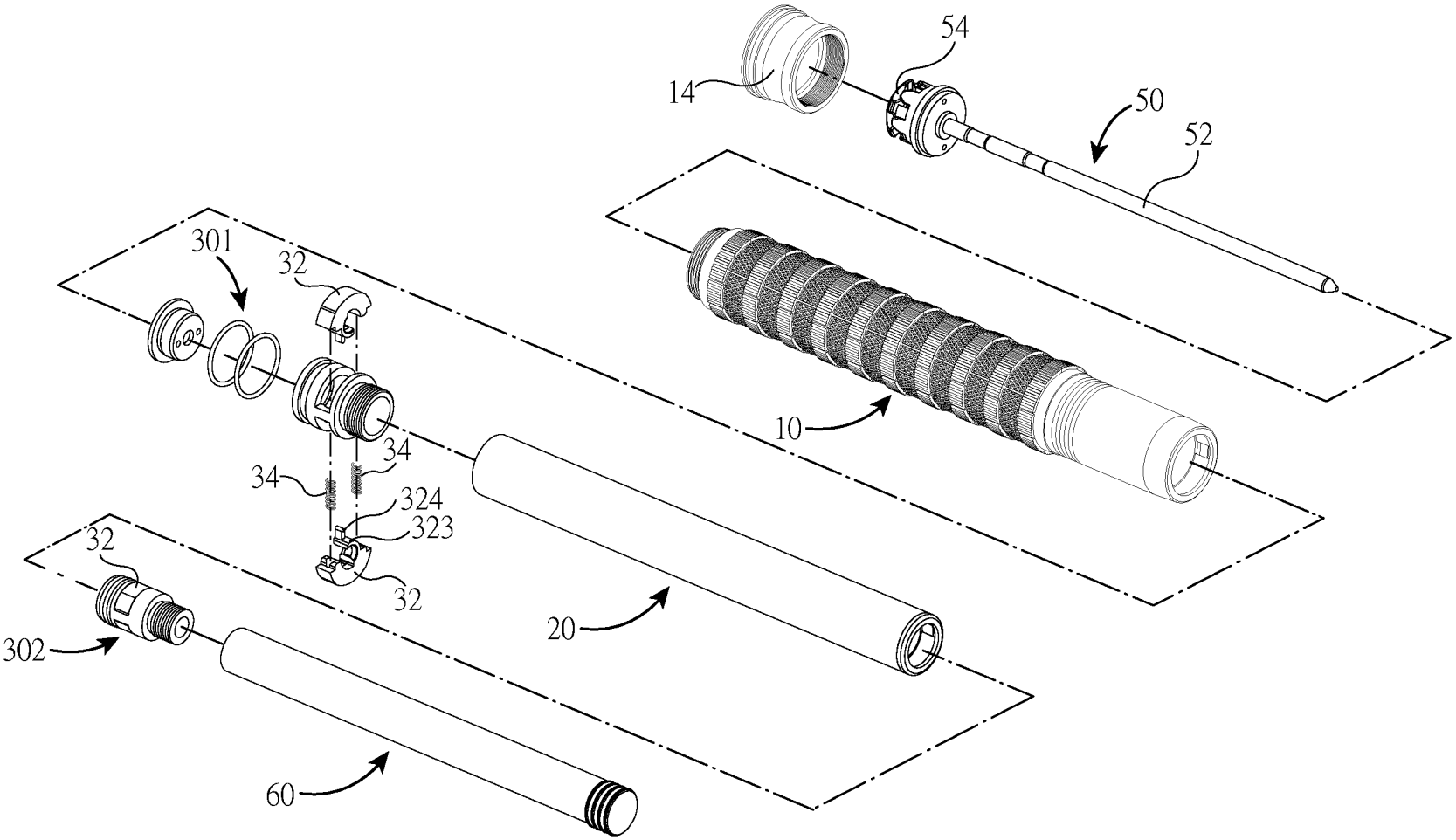
FIG. 1 is an exploded view of an expandable baton according to the invention.

Referring to FIGS. 1 to 4, an expandable baton in accordance with the invention comprises a first tube 10, a second tube 20, at least one lock mechanism 301, a release mechanism 50 and a positioning member 14 as discussed in detail below. The first tube 10 includes a first annular groove 12 on an inner surface. The second tube 20 is moveably disposed in the first tube 10. The lock mechanism 301 is disposed on a first end of the second tube 20, movably clamped to the first annular groove 12. The lock mechanism 301 includes a locking pipe 40, two lock protuberances 32 and two elastic members 34. The locking pipe 40 includes two shifting slots 42 positioned at two opposite walls and provided with a plurality of pillars 44 paralleled to each other and disposed between the two shifting slots 42, enabling the two lock protuberances 32 movably positioned in the two shifting slots 42. One end of each of the lock protuberances 32 further includes two hollow seats 321 positioned symmetrically, each of the hollow seats 321 provided with the correspondent elastic member 34. A concaved slot 322 is disposed between the two hollow seats 321. Each of the lock protuberances 32 is provided with an arch portion 323 elongated towards an end opposite from the hollow seats 321 forming an arch slot 3231 on an inner surface. A distance between each of the arch portions 323 and one end of the first tube 10 is equal to a length of the lock protuberances 32 and the one end of the first tube 10. An outer surface of the arch portion 323 is provided with a protrusion 324 projecting towards an end opposite from the concaved slot 322. The protrusion 324 and the concaved slot 322 are aligned axially and the protrusion 324 of one of the lock protuberances 32 is correspondent to the concaved slot 322 of the other lock protuberance 32. The protrusion 324 of one of the lock protuberances 32 is inserted into the concaved slot 322 of the other lock protuberance 32. The release mechanism 50 includes an axially moveable lock needle 52 having a pointed second end and a pushbutton 54 at a first end. The pushbutton 54 projects out of the first tube 10. The positioning member 14 limits the release mechanism 50 at a first end of the first tube 10. With the above mentioned structures, a pressing of the pushbutton 54 moves the lock needle 52 to insert into the lock mechanism 301, thereby the lock protuberances 32 move towards each other, depart from the first annular groove 12 simultaneously and urge the elastic members 34 to an unlocked position. Without a pressing of the pushbutton 54, the restored elastic members 34 enable the lock protuberances 32 to move away from each other and return to the first annular groove 12 simultaneously to a locked position. The two lock protuberances 32 are clamped to the first annular groove 12 at the same time.

Figure 2:
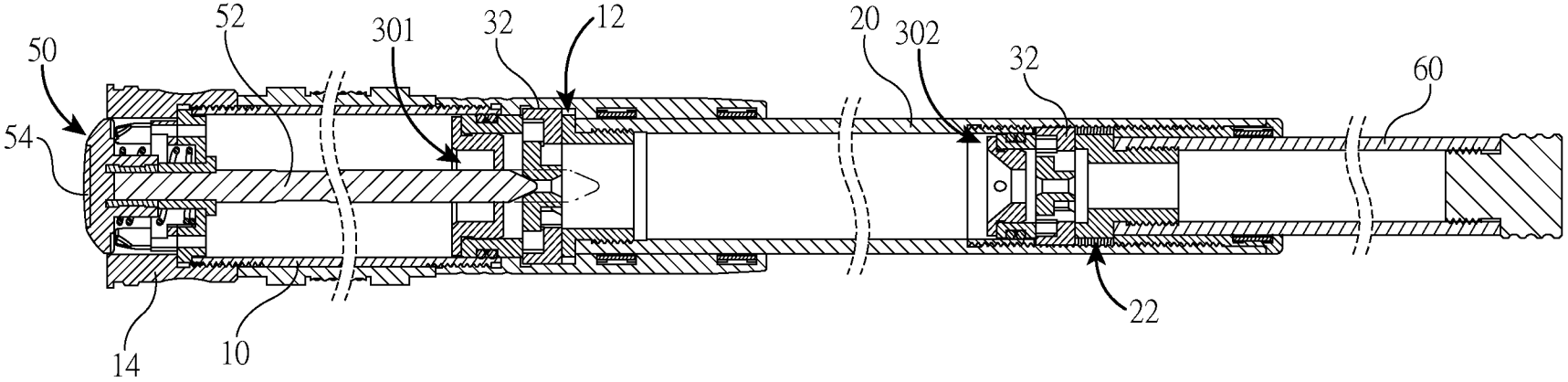
FIG. 2 is a longitudinal sectional view of the assembled expandable baton in an extended position.

As shown in FIG. 2 specifically, it is a longitudinal sectional view of the assembled expandable baton in an extended position. When the expandable baton is in an extended position, the lock mechanism 301 of the second tube 20 is clamped to the first annular groove 12 of the first tube 10. In this way, the expandable baton is extended. In order to expand the expandable baton further, a second annular groove 22 is disposed on an inner surface of the second tube 20 and a third tube 60 is moveably disposed in the second tube 20. A first end of the third tube 60 is provided with another lock mechanism 302 movably clamped to the second annular groove 22, enabling the third tube 60 to expand and clamp to a second end of the second tube 20 which is opposite from the first tube 10. At this time, the lock needle 52 of the release mechanism 50 is not yet inserted into the lock mechanisms 301, 302. The lock protuberances 32 of the lock mechanism 301 is correspondently clamped to the first annular groove 12, and the other lock mechanism 302 is correspondently clamped to the second annular groove 22. The lock mechanisms 301, 302 are in a locked position.

Figure 3:
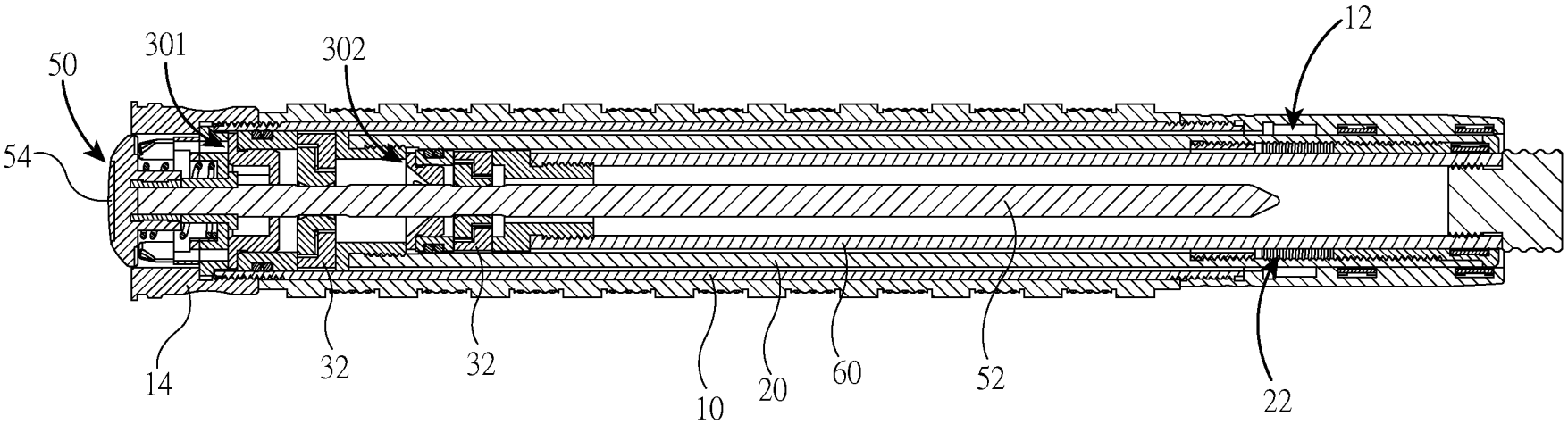
FIG. 3 is a view similar to FIG. 2, the assembled expandable baton being in a retracted position.

As shown in FIG. 3 specifically, it is a longitudinal sectional view of the assembled expandable baton in a retracted position. The lock needle 52 of the release mechanism 50 first passes the lock mechanism 301 and then is inserted into the other lock mechanism 302. As a result, the lock mechanisms 301, 302 are in an unlocked position. The lock protuberances 32 depart correspondently from the first annular groove 12 and the second annular groove 22. The second tube 20 is retracted into the first tube 10, and the third tube 60 is retracted into the second tube 20. As a result, the expandable baton is in an unlocked position.

Figure 4:
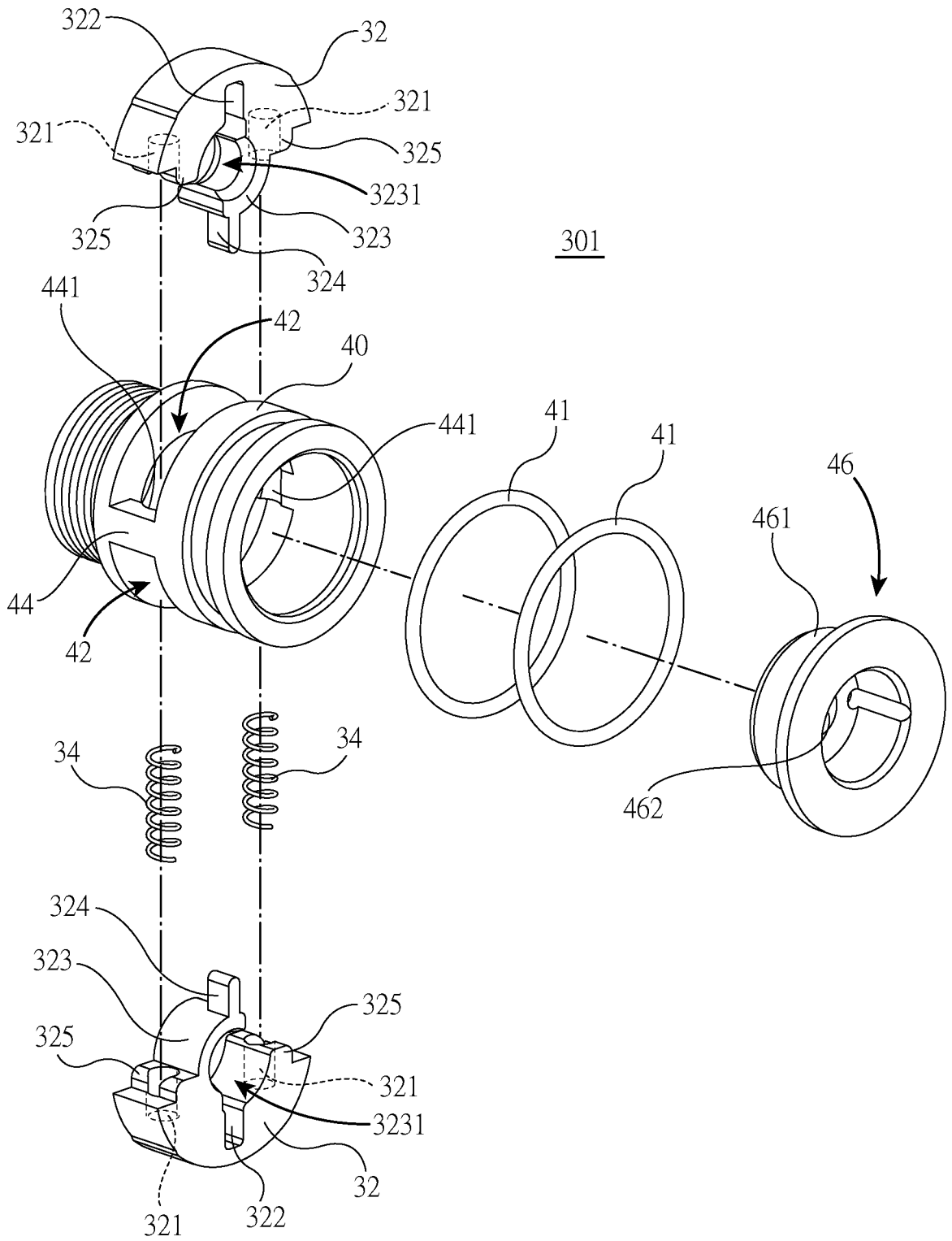
FIG. 4 is an exploded view of a lock mechanism.
Figure 5:
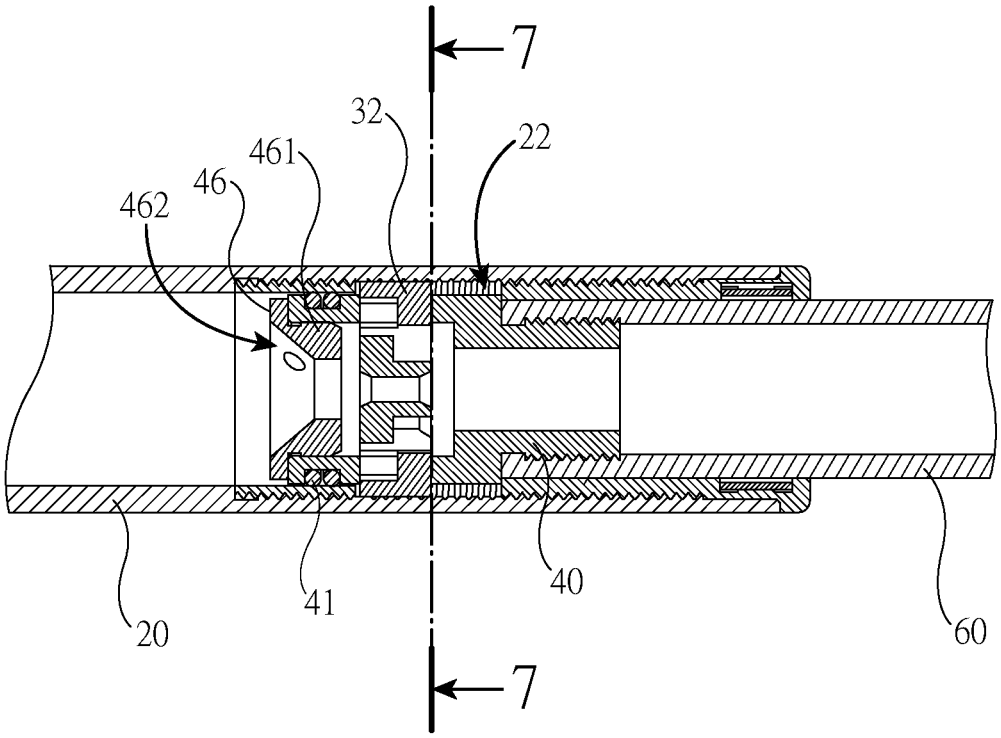
FIG. 5 is a longitudinal sectional view showing two lock protuberances moving away from each other and back to a first annular groove by restoring force of two elastic members, the lock mechanism being in a locked position.
Figure 6:
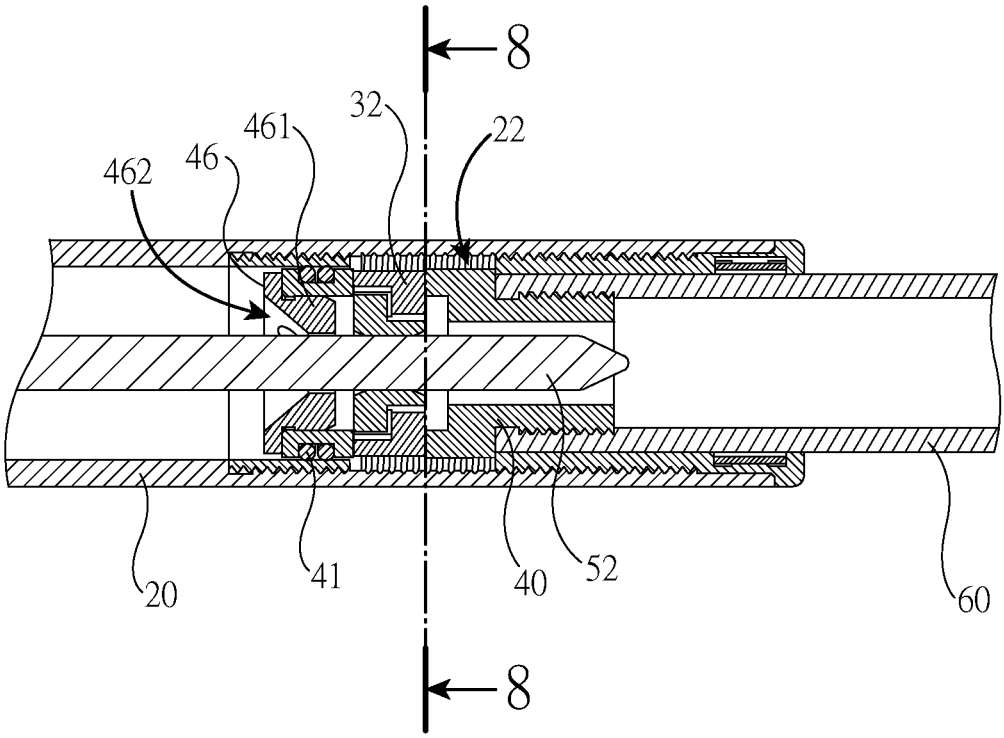
FIG. 6 is a longitudinal sectional view showing a lock needle inserted into the lock mechanism to push the lock protuberances moving towards each other and depart from the first annular groove, and urging the elastic members, the lock mechanism being in an unlocked position.

As shown in FIGS. 4 to 6 and in conjunction with FIGS. 2 to 3, at least one O-ring (two are shown) 41 is provided on an outer surface of the locking pipe 40 for the purpose of increasing friction. On an inner surface of each of the pillars 44 is provided with a trough 441. Each of the troughs 441 provides the correspondent elastic member 34 enough space to extend and retract. Each of the lock protuberances 32 is provided with at least one extension 325 extending from a same surface which the hollow seats 321 are disposed. The extensions 325 are provided on an outer edge of the elastic members 34, and can further limit the position of the elastic members 34. The locking pipe 40 further comprises a guiding member 46 that is provided with an annular flange 461 extended from an end of the guiding member 46. The annular flange 461 is clamped to an end of the locking pipe 40 that faces the lock needle 52. A guiding hole 462 is disposed through the guiding member 46. The guiding hole 462 provides the lock needle 52 to pass through and guides the lock needle 52 to a correct position. In addition, the guiding hole 462 is tapered shaped.

Figure 7:
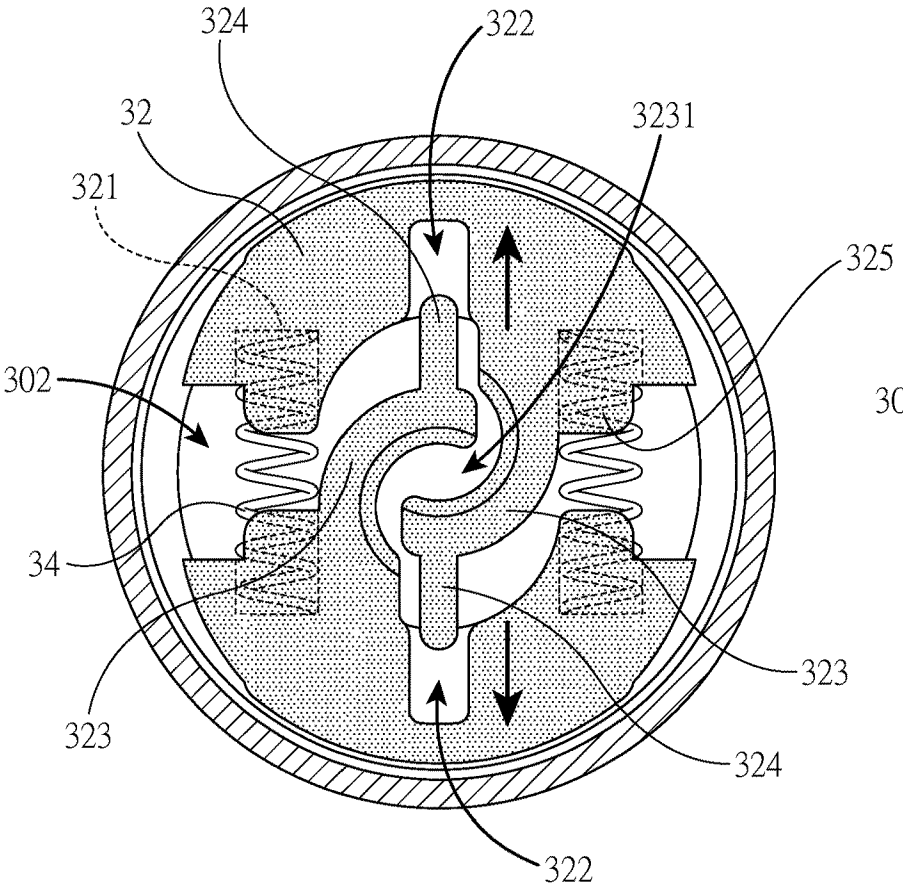
FIG. 7 is a sectional view taken along line 7-7 of FIG. 5.
Figure 9:
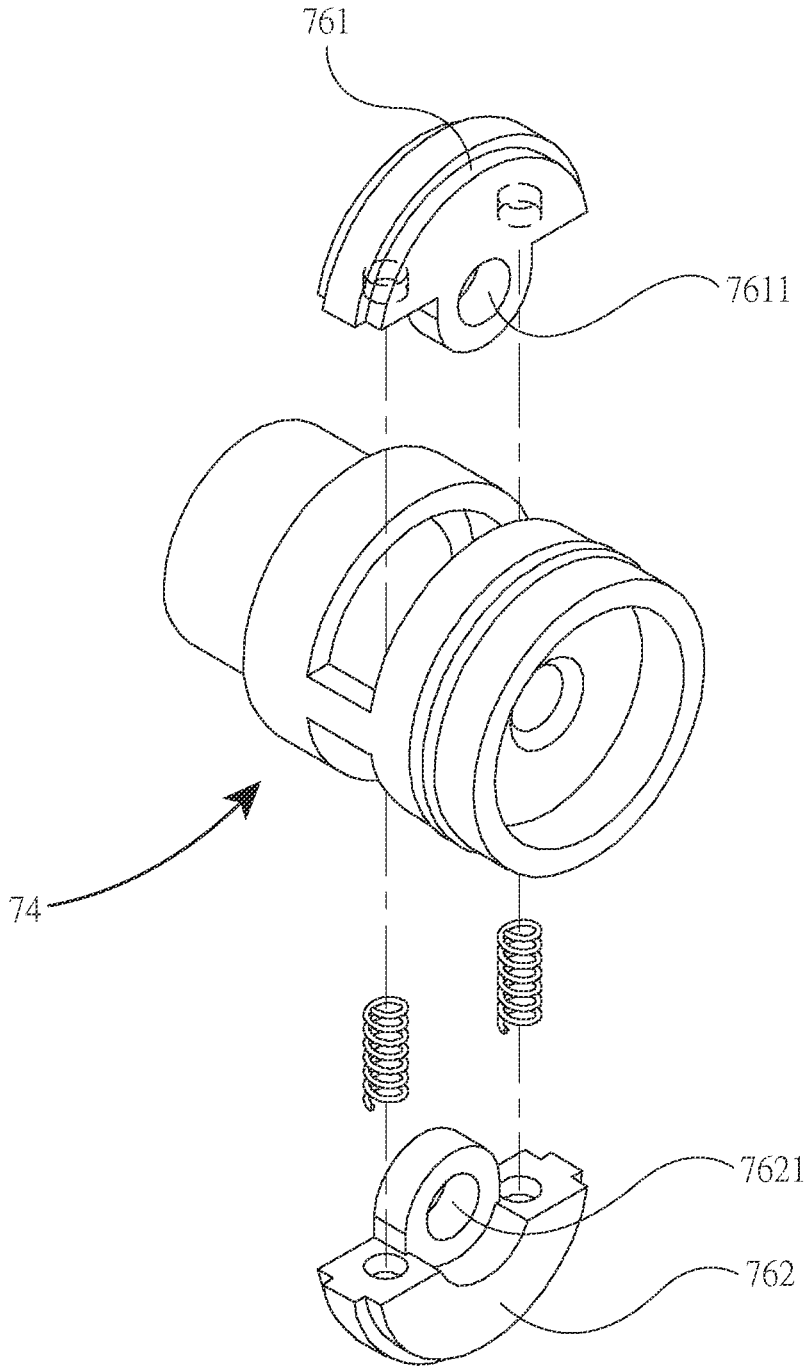
Prior Art FIG. 9
FIG. 9 is a perspective view according to the conventional art.
Figure 10:
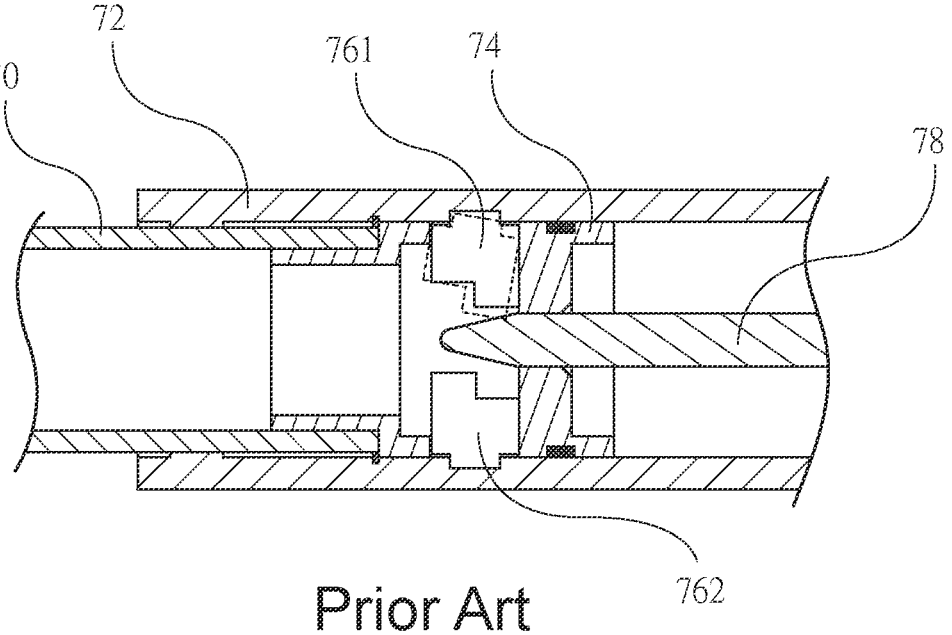
Prior Art FIG. 10
FIG. 10 is longitudinal sectional view showing the lock needle inserted into a first lock protuberance according to the conventional art.
Figure 11:
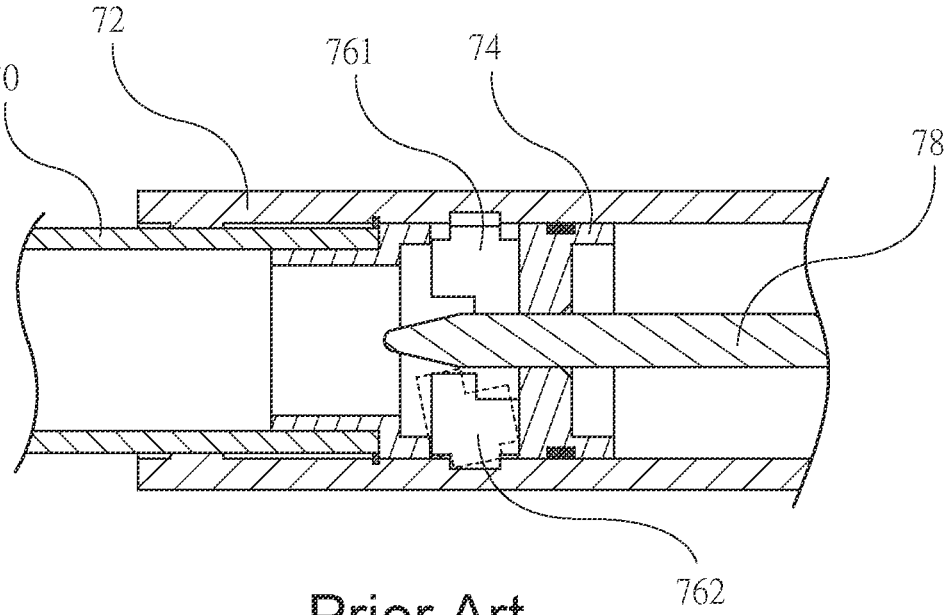
Prior Art FIG. 11
FIG. 11 is longitudinal sectional view showing the lock needle inserted into a second lock protuberance after passing through the first lock protuberance according to the conventional art.

As shown in FIGS. 5 to 7 and in conjunction with FIG. 4, when the lock mechanism 302 is not pushed by any outer force, the elastic members 34 urge the lock protuberances 32 to move away from each other, so the lock protuberances 32 are clamped to the second annular groove 22. The protrusions 324 depart from the correspondent concaved slots 322 with the arch portions 323 crossed together. As a result, the third tube 60 is clamped to the second tube 20.

Figure 8:
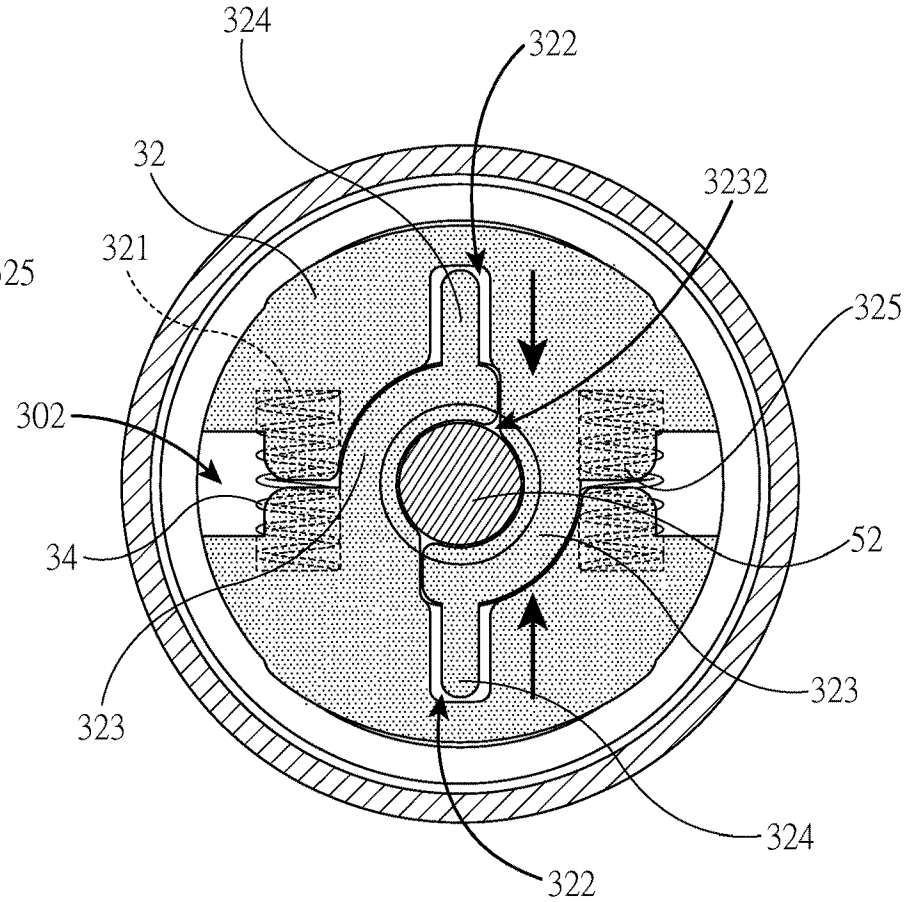
FIG. 8 is a sectional view taken along line 8-8 of FIG. 6.

As shown in FIGS. 6, 8 and in conjunction with FIG. 4, when the lock needle 52 is inserted into the lock mechanism 302, due to the tapered shape of the guiding hole 462, the guiding hole 462 guides the lock needle 52 to move along the tapered shape and reach the arch portions 323. While the lock needle 52 is inserted into the arch portions 323, the correspondent parts of the lock protuberances 32 are combined, and the arch slot 3231 is provided on an inner surface of the arch portions 323, forming a through hole 3232. Subsequently, the lock needle 52 pushes the arch portions 323 simultaneously without any time difference. The lock needle 52 pushes the arch portions 323 until passing through. At this time, the lock protuberances 32 move toward each other and urge the elastic elements 34. The lock mechanism 302 departs the second annular groove 22. By this way, the third tube 60 passes through the second tube 20.

While the invention has been described in terms of preferred embodiments, those skilled in the art will recognize that the invention can be practiced with modifications within the spirit and scope of the appended claims.

What is claimed is:

1. An expandable baton, comprising:

a first tube including a first annular groove on an inner surface;

a second tube moveably disposed in the first tube;

at least one lock mechanism disposed on a first end of the second tube, movably clamped to the first annular groove and including a locking pipe, two lock protuberances and two elastic members wherein the locking pipe includes two shifting slots positioned at two opposite walls and provided with a plurality of pillars paralleled to each other and disposed between the two shifting slots, enabling the two lock protuberances movably positioned in the two shifting slots, one end of each of the lock protuberances further including two hollow seats positioned symmetrically, each of the hollow seats provided with the correspondent elastic member, a concaved slot formed between the two hollow seats, each of the lock protuberances provided with an arch portion elongated towards an end opposite from the hollow seats and forming an arch slot on an inner surface, a distance between each of the arch portions and one end of the first tube is equal to a length of the lock protuberances and the one end of the first tube, an outer surface of the arch portion provided with a protrusion projecting towards an end opposite from the concaved slot, the protrusion and the concaved slot aligned axially, the protrusion of one of the lock protuberances is correspondent to the concaved slot of the other lock protuberance, the protrusions inserted into the concaved slots form a through hole;

a release mechanism including an axially moveable lock needle having a pointed second end and a pushbutton at a first end, the pushbutton projecting out of the first tube; and a positioning member for limiting the release mechanism at a first end of the first tube;

a pressing of the pushbutton moves the lock needle to insert into the lock mechanism, the lock protuberances departed from the first annular groove simultaneously and urged the elastic members to an unlocked position;

without a pressing of the pushbutton, the restored elastic members enable the lock protuberances to return to the first annular groove simultaneously to a locked position.

2. The expandable baton of claim 1, further comprising a second annular groove disposed on an inner surface of the second tube and a third tube moveably disposed in the second tube, a first end of the third tube provided with another lock mechanism movably clamped to the second annular groove.

3. The expandable baton of claim 2, further comprising a trough provided on an inner surface of each of the pillars, each of the troughs providing the correspondent elastic member enough space to extend and retract.

4. The expandable baton of claim 3, further comprising at least one extension extending from a same surface which the hollow seats are disposed and provided on an outer edge of the elastic member.

5. The expandable baton of claim 1, further comprising a guiding member provided with an annular flange extended from an end of the guiding member, the annular flange clamped to an end of the locking pipe that faces the lock needle and a guiding hole disposed through the guiding member, the guiding hole providing the lock needle to pass through and guiding the lock needle to a correct position.

6. The expandable baton of claim 1, further comprising at least one O-ring provided on an outer surface of the locking pipe.

* * * * *